US006305854B1

(12) United States Patent
Earle et al.

(10) Patent No.: US 6,305,854 B1
(45) Date of Patent: Oct. 23, 2001

(54) RELATING TO PHOTOGRAPHIC PROCESSES

(75) Inventors: Anthony Earle, Harrow Weald; Peter J. Twist, Great Missenden; Nigel R. Wildman, Watford; Richard N. Vernon, Stratford, all of (GB); Charles S. Christ, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/464,422

(22) Filed: Dec. 16, 1999

(30) Foreign Application Priority Data

Dec. 23, 1998 (GB) ..... 9828303

(51) Int. Cl.[7] ..... G03D 3/02; G03D 3/08

(52) U.S. Cl. ..... 396/612; 396/626; 396/636

(58) Field of Search ..... 396/612, 615, 396/617, 620, 626, 636; 355/27–29; 430/30

(56) References Cited

U.S. PATENT DOCUMENTS

| | | | |
|---|---|---|---|
| 3,335,026 | 8/1967 | Degeest et al. | 427/458 |
| 3,405,855 | 10/1968 | Daly et al. | 242/615.4 |
| 4,426,757 | 1/1984 | Hourticolon et al. | 226/196.1 |
| 4,427,166 | 1/1984 | Oishi et al. | 226/196.1 |
| 4,835,004 | 5/1989 | Kawanishi | 427/458 |
| 4,837,045 | 6/1989 | Nakajima | 427/458 |
| 4,864,460 | 9/1989 | Muramatsu et al. | 361/220 |
| 4,943,823 | 7/1990 | Uchiyama et al. | 396/619 |
| 5,122,386 | 6/1992 | Yoshida | 427/520 |
| 5,239,328 * | 8/1993 | Wernick et al. | 396/620 |
| 5,295,039 | 3/1994 | Nakajima et al. | 361/225 |
| 5,365,300 | 11/1994 | Wernicke et al. | 396/617 |
| 5,431,321 | 7/1995 | Link et al. | 226/190 |
| 5,609,923 | 3/1997 | Clarke | 427/458 |
| 5,975,774 * | 11/1999 | Blakely et al. | 396/626 |

FOREIGN PATENT DOCUMENTS

| | | |
|---|---|---|
| 0 390 774 B1 | 12/1987 | (EP) . |
| 0 563 989 | 4/1992 | (EP) . |
| 0 491 049 | 6/1992 | (EP) . |
| 0 501 229 | 9/1992 | (EP) . |
| 0 530 752 A1 | 9/1992 | (EP) . |
| 89/05477 | 12/1987 | (WO) . |

OTHER PUBLICATIONS

JP abstracts vol. 014, No. 274 (P–1061), Jun. 13, 1990 & JP 02 079841 A (Konica Corp.), Mar. 20 1990.

* cited by examiner

*Primary Examiner*—D. Rutledge
(74) *Attorney, Agent, or Firm*—Frank Pincelli

(57) ABSTRACT

A method of processing photosensitive material which passes through at least two processing solutions in which the material is rinsed after passing through a first solution and prior to passing through the second solution. The mixture of rinse solution and recovered first solution is returned to the process cycle to replenish the first solution.

14 Claims, 4 Drawing Sheets

IRON REDUCTION (%) AS FUNCTION OF REP RATE

WASH SAVINGS (%) VS REP RATE

WASH SAVINGS (%) VS REP RATE

RELATING TO PHOTOGRAPHIC PROCESSES

FIELD OF THE INVENTION

This invention relates to improvements relating to photographic processes, in particular to improvements in the efficiency of the processes.

BACKGROUND OF THE INVENTION

Photographic material as referred to herein may comprise film, paper or any other photosensitive material and may produce a black and white or colour image.

Silver halide photographic material is well known and is processed to generate an image by passing the material through a development stage followed by a series of baths or tanks to stabilise and provide permanence to the image. The baths convert and remove unwanted materials from the photographic layers which would interfere with the quality of the final image. In a typical colour system the development stage is followed by a bleach stage to oxidise the developed silver to a form which can be dissolved by a fixing agent, either in the same bath/tank or in a separate bath/tank. The silver removal stage is followed by a washing stage using a wash solution or a stabilisation stage. These stages remove any residual chemicals from the material.

At each stage the solutions must be replenished.

Normal replenishment refers to replenishment made by a single "made-up" solution prepared by mixing concentrated parts with water in a separate replenisher tank outside the processing tank itself The concentrated parts are supplied by photographic manufacturers in a kit consisting of one or more concentrated solutions such as those for Kodak RA Prime Developer replenisher which currently consists of three parts A, B and C.

Direct replenishment (D-rep) refers to replenishment by separate concentrated parts plus a water part supplied directly into the processing tank. For Kodak Ektacolor SM developer replenisher this consist of three parts A, B and C plus a water parl These are metered into the processing tank, each with a separate pump. It is clear that more or less than three parts can also be used.

In direct replenishment plus cross-over wash the water part that would have gone directly into the first processing tank is now used to rinse the paper in the crossover between the first and second processing tanks. Some of the rinse water and the washed out components pass back into the first processing tank.

The cross-over can be between any two stages of a photographic process, which could contain developer, bleach, fix, bleach-fix, wash, stabiliser, reversal bath, conditioning bath, amplification bath or, intensification bath, etc.

When processing photographic material it is necessary for the material to pass through several different chemical solutions as described above. In conventional processors with tanks in series as the material passes from one solution to another the chemicals from a first solution are carried over by the emulsion layers of the sensitised material to the next solution. This causes seasoning of the next solution which can lower its effectiveness, particularly for the bleach-fix in the case of rapid processing. In addition carry-over of bleach-fix into the wash reduces the wash efficiency and increases the wash replenishment rate.

SUMMARY OF THE INVENTION

It is an aim of the invention to provide a process in which carry-over of chemicals from one tank to another is prevented.

In accordance with the present invention there is provided a method of processing a photosensitive material in which the material passes through at least two processing solutions, the material being rinsed with a rinse solution after passing through a first solution and prior to passing through a second solution to prevent the carry-over of the first solution to the second solution, the resulting mixture of rinse solution and recovered first solution being returned to replenish the first solution.

In a preferred embodiment the rinse solution is water.

The first solution can be replenished by the D-rep method with concentrated solutions consisting of parts A, B, C and water. The rinse water is water that would have been used to replenish the first solution even without the rinse stage so that no extra water is needed for the rinse stage, other than that normally used for replenishment of the first solution. The water performs the two functions of rinsing and replenishment.

The invention further provides a processing apparatus for processing photosensitive material, the apparatus having at least two processing stages and comprising; means for passing the material through a first process solution; means for passing the material through a second process solution; means for rinsing the material after passage through the first process solution and prior to passage through the second process solution; and means for directing the resulting mixture of rinse solution and recovered first solution to replenish the first process solution.

In a preferred embodiment the processing apparatus is an inclined plane processor for processing material at an inclined angle.

Use of the invention prevents carry-over of the developer into further solutions. This leads to a reduction in contamination between the solutions used in the process. The bleach-fix stage is more efficient and has a longer life.

The method also prevents carry-over of bleach-fix into the first wash or stabiliser tank, resulting in a more efficient wash stage with reduced replenishment rate.

The water used for the rinse is part or all of that which would normally be added for use as the replenisher solutions.

The method is applicable for any two tanks of any composition and for any process cycle. The method is equally applicable to film and paper processing or any other photosensitive material, to colour or black and white processing or reversal processing.

For a better understanding of the present invention, reference will now be made, by way of example only, to the following drawings.

DETAILED DESCRIPTION OF THE INVENTION

Figure 1:
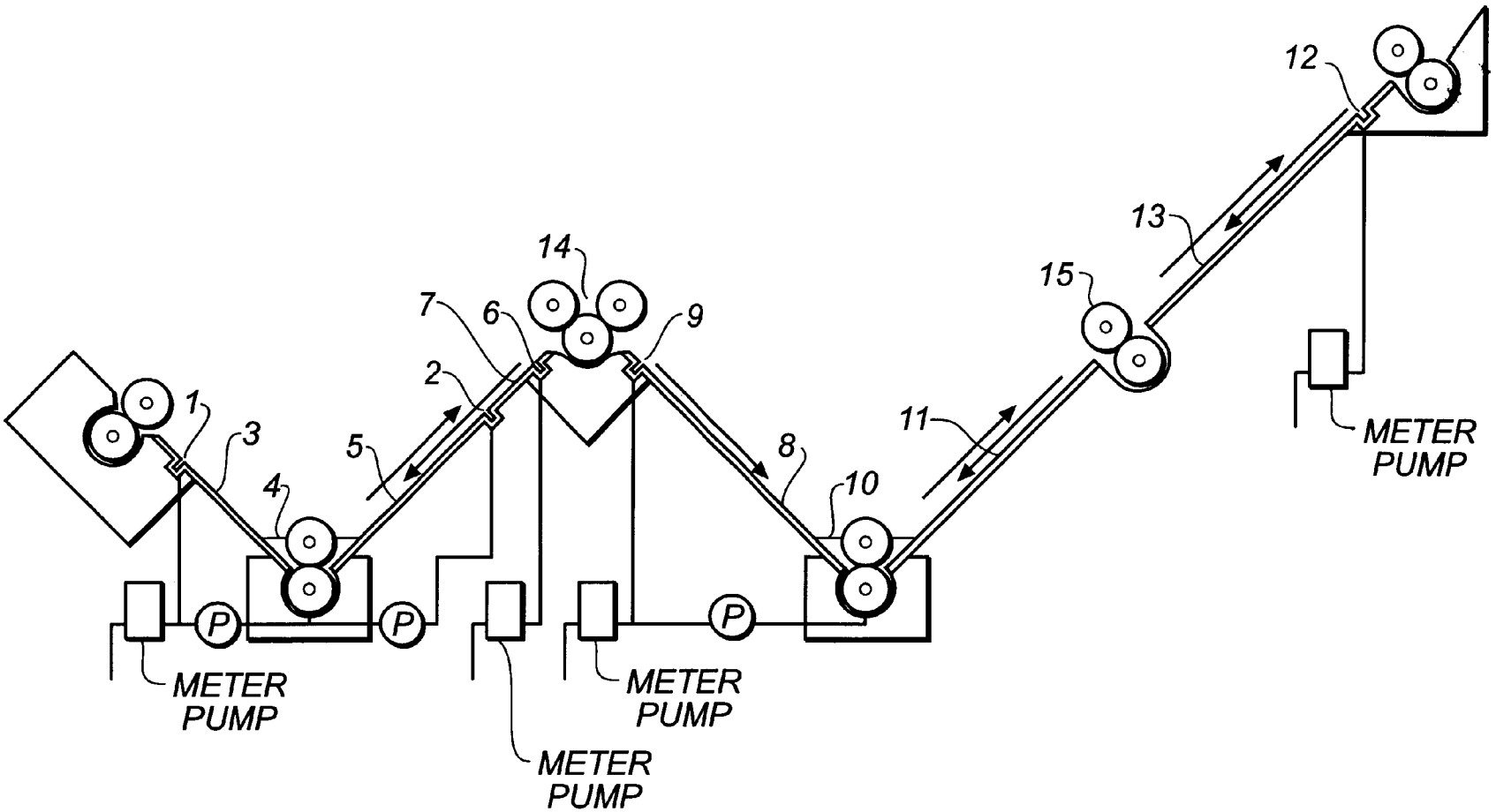
FIG. 1 shows an apparatus according to an embodiment of the invention.

FIG. 1 shows an inclined plane processor for processing material at an inclined angle. The processor comprises a development stage (plane 3 and the lower part of plane 5), a bleach-fix stage (plane 8) and a final washing/stabilizing stage (planes 11 and 13).

At the top of inclined plane 3 there is provided a slot 1 for the introduction of developer solution. A similar slot 2 is located towards the upper part of plane 5, preferably approximately one quarter of the plane length from the top of the plane. The slots 1, 2 are connected to a supply of developer solution. In the embodiment shown in FIG. 1 a second slot 6 is provided at the top 7 of plane 5. Slot 6 is in connection with a supply of water or other wash solution.

A slot 9 is located at the top of inclined plane 8. Slot 9 is for the introduction of bleach/fix solution. A further slot 12 is provided at the top of inclined plane 13. Slot 12 is in connection with a supply of wash or stabiliser solution.

Troughs 4 and 10 are provided between adjacent inclined planes 3 and 5 and 8 and 11, respectively. The solutions which run down the planes and collect in these troughs are recirculated via pumps P and the appropriate slots. A further trough 42 is provided at the apex of inclined planes 5 and 8.

In the embodiment shown in FIG. 1 a pair of rollers 15 is located between planes 11 and 13.

In use, the invention works as follows;

The photographic material, hereinafter referred to as paper, passes down plane 3. Developer solution is metered out of slots 1 and 2 and passes under the paper. The paper passes down plane 3, through the small trough 4 and up plane 5. Development occurs over this path. Part of the water (for example, 0–15 ml/sq.ft or 161.4 ml/sq.m) that goes to make the developer replenisher is diverted from the meter pump MP1 (in connection with a reservoir, not shown) where for D-rep replenishment it would have been mixed with concentrates A, B and C, and exits slot 6 at the top of the plane 5. The water flows down the plane 5 and mixes with the developer lower down the plane. Development occurs on plane 3 and on the lower part of plane 5. Washing occurs on the upper part of plane 5 and the developer contained within the emulsion layers of the paper is washed down plane 7 and mixes with the rest of the developer lower down plane 5. The paper then passes through the cross-over and down plane 8. There is substantially no carry-over of developer components into the next stage which occurs on plane 8. Bleach-fix is pumped out of slot 9 and runs down plane 8 under the paper. Since the paper was washed on plane 7 above plane 5 substantially no developer components season into the bleach-fix. The bleach-fix thus retains a higher bleaching rate, has reduced replenishment requirements and is more stable over time.

The paper passes down plane 8, through the small trough 10 and up plane 11, through rollers 15 and up plane 13. Water or stabiliser passes out of slot 12 and down planes 13 and 11, washing or stabilising the paper as it travels up the plane.

EXAMPLE

RA-Prime developer has a CD3 concentration of 4.35 g/l and the developer-replenisher 6.8 g/l and a replenishment rate of 15 ml/sq.ft (161.4 ml/sq.m). The usage rate(UR) of CD3 by the paper can be calculated as follows:

$$\text{CD3 into tank from replenisher} = \text{CD3 lost(carry-out+overflow)} + UR \quad (1)$$

Normal Operation $$15 \times 6.8 = 15 \times 4.35 + UR \text{ mg/sq.ft}$$

UR=36.75 mg/sq.ft

For the process of the present invention the replenishment rate is kept the same(15 ml/sq.ft) but 3.0 ml/sq.ft of developer carry-out is saved since this volume is now just water. Thus overflow+carry-out of developer is lowered from 15 to 12 ml/sq.ft. and 3.0 ml/sq.ft of the total input volume of 15 ml/sq.ft is now water. The usage rate by the paper is still 36.75 mg/sq.ft as this is defined by the average customer density. So the concentration of CD3 in the replenisher can be lowered as follows:

from equation (1) the mass balance is now;

Operation in the Invention $$15 \times R = 12 \times 4.35 + 36.75$$

where R is the new concentration of CD3 in the replenisher.

R=5.9 g/l the normal level is 6.8 g/l so this results in a 13.2% saving in CD3.

In order to maintain the same halide concentration in the developer the level of potassium chloride in the developer-replenisher needs to be lowered as follows. The developer concentration of KCl is 6.4 g/l and the developer-replenisher is 4.5 g/l; the increase is due to seasoning from the paper. In order to maintain 6.4 g/l in the developer the new level in the developer-replenisher can be calculated;

Normal Operation $$15 \times 4.5 = 15 \times 6.4 + Ucl$$

where Ucl is the usage rate or discharge rate of KCl from the paper into the developer.

Ucl=−28.5 mg/sq.ft

Operation in the Invention $$15 \times Cl = 12 \times 6.4 + (-28.5)$$

where Cl is the new concentration of chloride in the replenisher.

$$Cl = 3.2 \text{ g/l}$$

Figure 2:
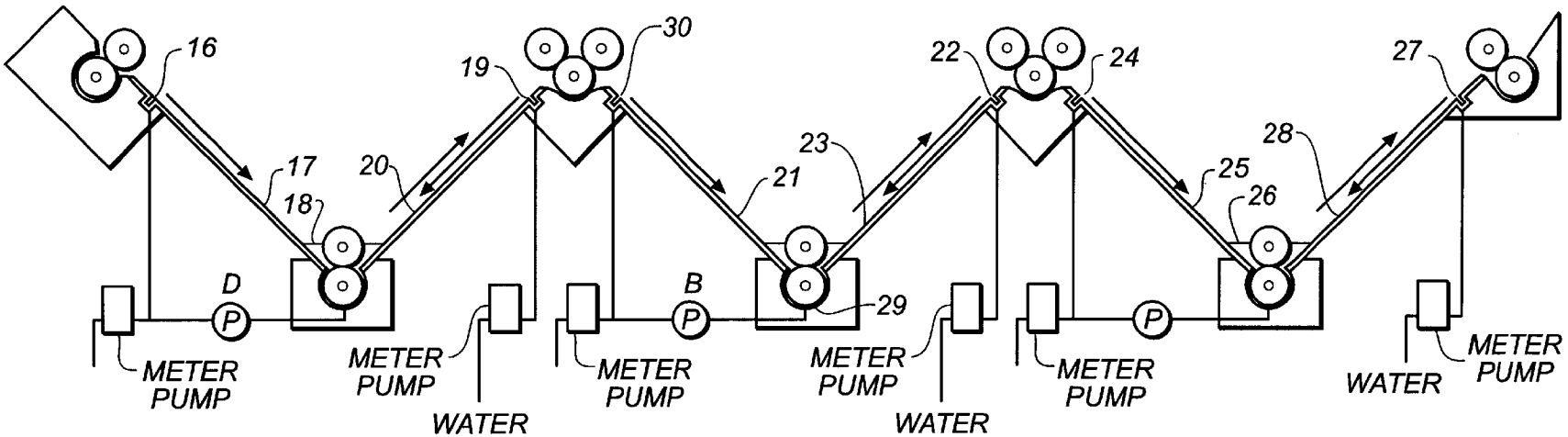
FIG. 2 shows an apparatus according to another embodiment of the invention.

FIG. 2 shows an alternative inclined plane processor used in accordance with the invention.

The processor comprises a development stage (planes 17 and 20), a bleach-fix stage (plane 21), a stabiliser stage (plane 25) and a final washing stage (plane 28).

Each inclined plane 17, 20, 21, 23, 25, 28 is provided with a slot at the top thereof. Inclined plane 17 has slot 16 for the introduction of developer solution. Inclined plane 20 has slot 19 for the introduction of water or other wash solution. Inclined plane 21 has slot 30 for the introduction of bleach-fix. Inclined plane 23 has slot 22 for the introduction of water. Inclined plane 25 has slot 24 for the introduction of stabiliser solution Inclined plane 28 has slot 27 for the introduction of water or other wash solution.

Troughs 18, 29, 26 are provided between adjacent inclined planes 17 and 20, 21 and 23, 25 and 28. The solutions which flow down the planes and collect in the troughs are recirculated via the appropriate slots. Further troughs are provided at the apex of inclined planes 20 and 21 and 23 and 25.

Paper passes down plane 17. Developer solution passes out of slot 16, down plane 17 and into the small trough 18. The developer is recirculated via pump P. The paper is developed as it passes down plane 17 and through the small trough 18. Water passes out of slot 19, flows down plane 20 and into the small trough 18. The water passing out of slot 19 is part of the water (for example, 0–15 ml/sq.ft or 161.4 ml/sq.m) for the developer-replenisher(15 ml/sq.ft or 161.4 ml/sq.m). The paper passes up plane 20 where it is washed and the developer components which are substantially removed from the paper flow down plane 20 and into the recirculated system for the developer. This lowers the loss of developer components normally lost by carry-out. The paper then passes over the crossover from inclined plane 20 to inclined plane 21. Bleach-fix exits from slot 30, passes down the plane 21 and into the small trough. Paper passes down plane 21 where it is bleach-fixed. There is no carry-over of developer components into the bleach-fix so that the bleach-fix retains its activity. Part of the water that goes to make the bleach-fix solution is metered out of slot 22 and down plane 23. The paper is therefore washed as it moves up plane 23. The bleach-fix components washed out of the paper pass down plane 23 and into the bleach-fix recirculation system via trough 29. Stabiliser or water exits slot 24, down plane 25 and into the small trough 26. The paper passes down plane 25 and is washed or stabilised. Water or stabiliser exits slot 27, down plane 28 and into the small trough 26. The paper is washed or stabilised as it passes up plane 27.

This method saves on developer components(13.2%) as described earlier but also has greater savings(15% or more) in the bleach-fix because only water is carried-in and substantially no bleach-fix components are carried-out.

In a further embodiment the configuration shown in FIG. 1 is modified by providing an exit weir between slots 2 and 6. The water which exits through slot 6 passes down the plane 7, but before it is mixed with the developer which exits slot 2, it is diverted downwards through the weir so that it does not mix with the developer which exits slot 2. The diverted water is passed into the recirculation system of the developer stage.

Figure 3:
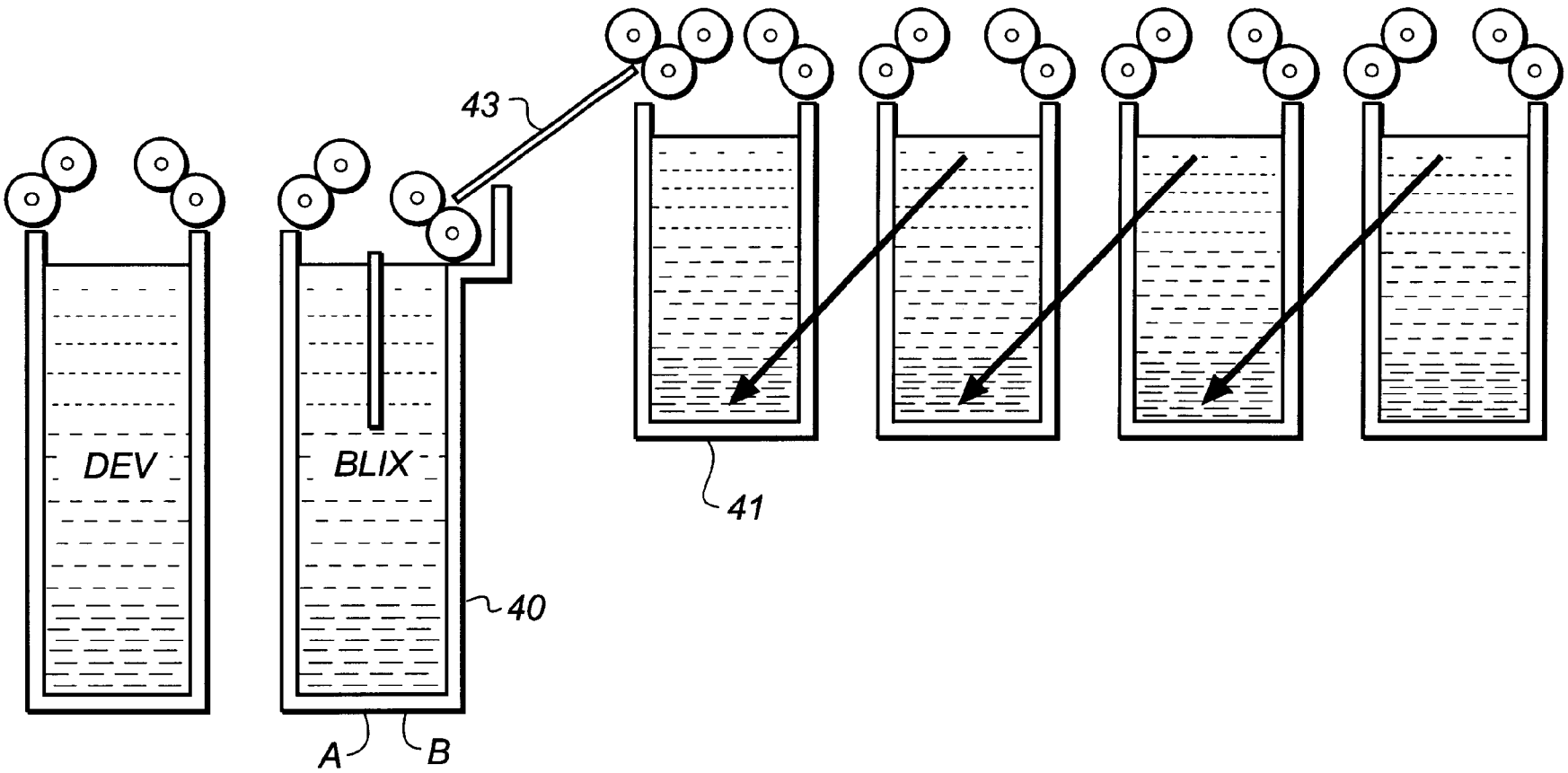
FIG. 3 shows a further apparatus in accordance with the invention.

In yet another embodiment, illustrated schematically in FIG. 3, savings can also be made in the wash of a process by similar means using a washing crossover between the bleach-fix tank 40 and first wash tank 41. Parts A and B are the concentrated solutions for replenishment and can be any number above one. The bleach-fix parts are concentrated to the maximum concentration practically attainable and the water volume saved is added as a third replenisher to the bleach-fix. This water is added to the washing crossover 43 which dilutes the solution carried out by the paper gel into the wash bath. All water added to this crossover cascades back into the bleach-fix tank 40 where it dilutes the replenishers to tank concentration. Several benefits can be drawn. Firstly, the bleach-fix carryout is reduced by approximately one half, reducing the total usage of bleach-fix components. This means that the concentrations of the bleach-fix components can be reduced in the replenishers. The silver concentration will rise slightly as this route to silver loss will be reduced. The second benefit is that the carry-over of bleach-fix tank solution into the first wash tank 41 is also reduced by approximately half. Hence, the wash replenishment rate required to control the final tank concentrations of hypo and iron can be reduced by up to 60% depending on:

1. The amount of bleach-fix replenishment water available for washing in the crossover;
2. The effectiveness of the squeegee rollers after the washing crossover, but before the first wash;
3. The time spent on the washing crossover.

EXAMPLE

The washing crossover may consist of a sheet of PVC of the paper width with a textured diamond pattern. Each diamond acts as a micro tank. The crossover is mounted at 25–500° to allow slow run off. Water is introduced at the top of the crossover via small holes (0.5–1.0 mm). The rate of water delivery is dependant upon the paper linear speed and the water D-Rep rate for bleach-fix.

The amount of water that can be added to the cross-over is dependant upon the formulation of the bleach-fix kit parts. Water cannot be extracted from the RA2SM formulation as the ferric ammonium EDTA part cannot be made any more concentrated, due to the inclusion of acetate as a buffer. If a three part kit could be made, such as RA4NR, the acetate being the third part, the ferric ammonium EDTA concentration can be increased, this yields more water for use in the crossover. Furthermore in a fast process bleach-fix acetate is avoided and hence the benefits of the RA4NR formulations can be obtained without the need for a third part.

The table below shows the water available per square meter of processed paper, the example will examine flow rates in this region.

TABLE

| Bleach-fix | Total replenishment rate (ml/m$^2$) | Water needed to make (ml/m$^2$) |
|---|---|---|
| RA4/PRIME LU | 215 | 139 |
| PRIME | 108 | 54 |
| PRIME LORR | 54 | 0 |
| RA4 NR/RAPID (3 part) | 54 | 27 |
| RA2SM | 26.4 | 0 |

EXAMPLE

Ektacolor paper was bleach-fixed in for 45 seconds and the excess bleach-fix squeegeed from the surface of the paper. The bleach-fix containing paper was then passed up an inclined plane washing crossover at 4 meters per minute. 4 meters per minute represents an average Minilab paper speed.

The angle of the inclined plane was 30°, but this may be altered. The water is delivered via the tube which feeds the four holes from the rear. Once passed over the crossover (contact time 1.5 seconds) the paper was squeegeed to mimic the effect of squeegee rollers. The flow rates used were changed and the retained iron determined by HPLC for each condition.

Figure 4:
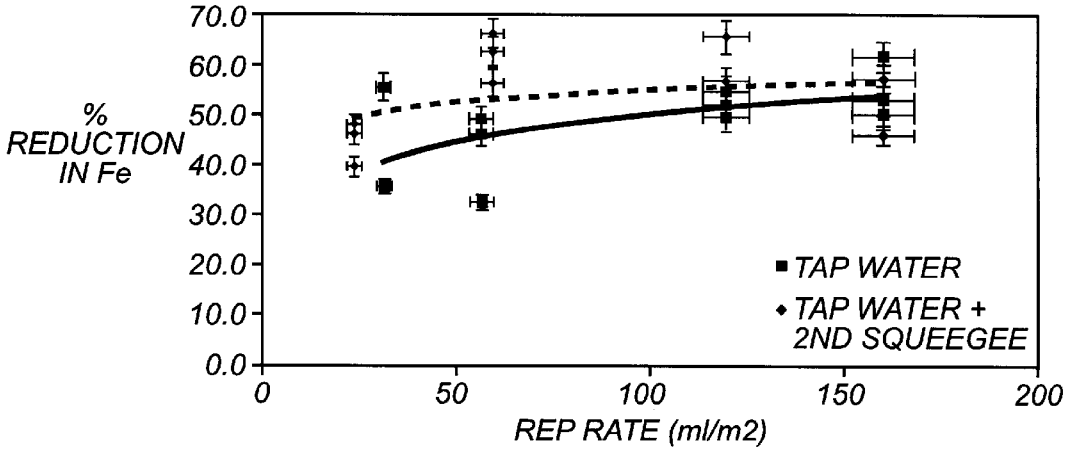
FIG. 4 is a graph showing replenishment rate against percentage reduction in iron.

FIG. 4 shows a graph of replenishment rate versus percentage reduction in iron referenced against a paper strip that was just bleach-fixed and squeegeed. This represents the normal amount of carried over iron into the first wash tank. It can be seen from FIG. 4 that the inclusion of a second squeegee after the washing crossover increases the efficiency of carryover reduction by approximately 10%.

Figure 5:
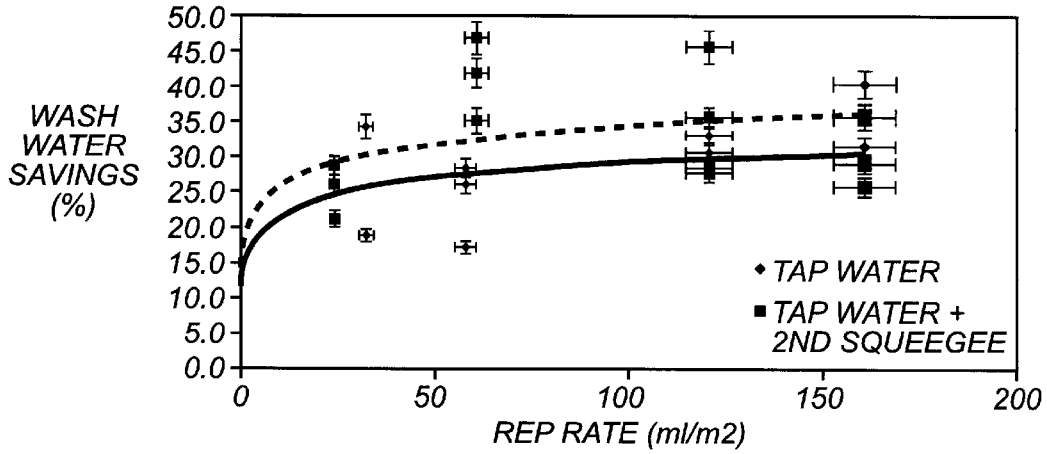
FIG. 5 is a graph showing expected wash water savings for different replenishment rates.

Knowing the reduction in the amount of iron carried over from the bleach-fix the expected reduction in the wash water replenishment rate or wash savings can be calculated based on 4 counter-current wash tanks. The expected savings are shown in FIG. 5 for the different replenishment rates.

This translates into an increased wash saving of ~30% taking approximately 60 ml/m$^2$ off the replenishment rate. Hence wash replenishment rates can be reduced from 193 ml/m$^2$ to around 133 ml/m$^2$ by using no extra water than is currently incorporated in the process.

Figure 6:
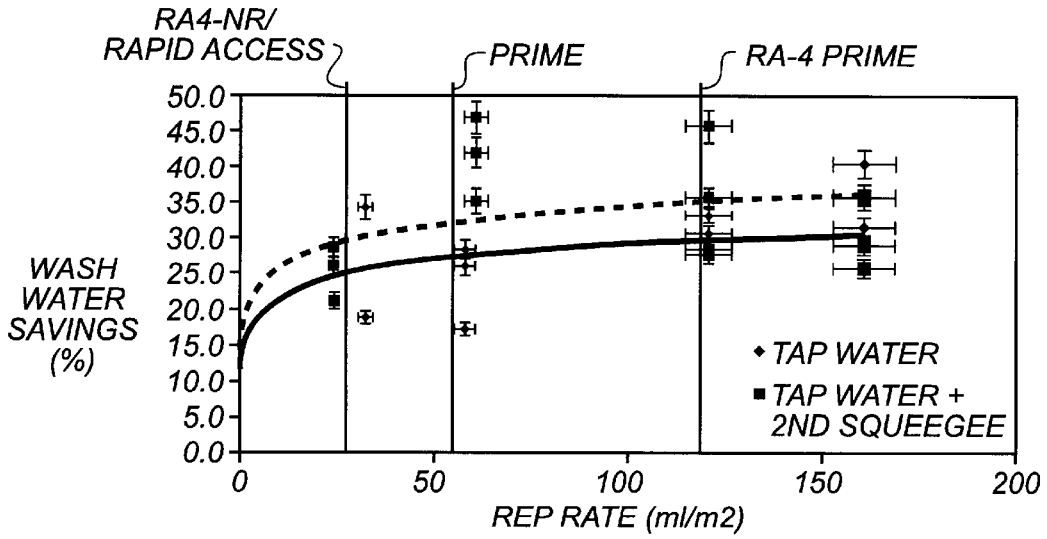
FIG. 6 is a graph showing the expected replenishment rates of bleach-fix water achieved by use of different bleach-fix formulations.

FIG. 6 shows the expected replenishment rates of bleach-fix water which could be achieved by the use of different bleach-fix formulations. This data comes from the table above.

The wash model assumes that during washing the concentration of contaminants within the gel is reduced according to an inverse exponential law. The model is based around an earlier model, and predicts the concentration in the final tank of a series, that is, the concentration of contaminants retained within the gel going into the final drying stage. The original model assumed that equilibrium is achieved in each tank, though in some cases considered here, this is not the case and another term was included to take into account situations when wash time was short and equilibrium was not achieved.

A final tank concentration was calculated for standard RA4 conditions of 18 mls/ft$^2$ (193.7 ml/m$^2$) and 4 tanks at 22.5 seconds. For each of the data points gathered in the experiments, the percentage reduction in iron that would be seen going into the first bath was entered, and another, lower, final ($4^{th}$) tank concentration was obtained from the model.

The replenishment rate in the second case could then be calculated so as to obtain the same final tank concentration as in the standard case. Thus the potential saving in wash replenishment rate could be quantified.

Alternatively, the standard case could be matched by shortening the wash time.

From the experimental results reported above it can be seen that the invention substantially improves process efficiency. The problem of developer chemicals seasoning the bleach-fix chemistry and lowering its effectiveness is avoided. In addition only the same amount of water is used and some of the developer chemistry can be re-used.

In the embodiments described the rinse water has been added after the developer solution. However, the rinse water could be added after the bleach-fix stage. It is also possible to have the rinse water added at both stages. It is possible to have the rinse water between additional stages for any conceivable photographic process. The rinse water can be used between any pair of stages, between all stages or in any combination.

Although the invention has mainly been described with reference to inclined plane processors it will be understood by those skilled in the art that it is equally applicable to other processors where there is a crossover between tanks. The cross-over rinse can also be a small tank of low volume.

Although a water rinse is described the rinse solution could in principle be any solution that is convenient. The rinse solution could contain any component that would be useful in the process and could be of regulated pH (between 2 and 14) and could be of convenient viscosity or intentionally adjusted viscosity by means of added thickening agents.

PARTS LIST

1. slot
2. slot
3. inclined plane
4. trough
5. lower part of plane
6. slot
7. upper part of plane
8. inclined plane
9. slot
10. trough
11. inclined plane
12. slot
13. inclined plane
15. pair of rollers
16. slot
17. inclined plane
18. trough
19. slot
20. inclined plane
21. inclined plane
22. slot
23. inclined plane
24. slot
25. inclined plane
26. trough
27. slot
28. inclined plane
29. trough
30. slot
40. bleach-fix tank
41. wash tank
42. trough
43. crossover

What is claimed is:

1. A method of processing a photosensitive material in an inclined plane processor in which the material passes through at least two processing solutions, the material being rinsed with rinse solution after passing through a first solution and prior to passing through a second solution to prevent the carry-over of the first solution to the second solution, the resulting mixture of rinse solution and recovered first solution being returned to replenish the first solution.

2. A method according to claim 1 wherein water is used as the rinse solution.

3. A method according to claim 2 wherein the water used for the rinse comprises all of the separate water part required to make the replenisher for the first solution.

4. A method according to claim 2 wherein the water used for the rinse comprises part of the separate water part required to make the replenisher for the first solution.

5. A method according to claim 1 wherein there are two or more processing solutions, the material being rinsed between any two stages of the processing and the resulting mixture of rinse solution and recovered first solution used to replenish the first solution.

6. A method according to claim 1 wherein the rinse solution is introduced on the inclined plane before the second solution.

7. A processing apparatus for processing photosensitive material, the apparatus having at least one inclined plane and at least two processing stages, the apparatus comprising; means for passing the material through a first process solution; means for passing the material through a second process solution; means for rinsing the material after passage through the first process solution and prior to passage through the second process solution; and means for directing the resulting mixture of rinse solution and recovered first solution to replenish the first process solution.

8. A processing apparatus as claimed in claim 7 wherein the rinse solution is water.

9. A processing apparatus as claimed in claim 8 wherein the water used for the rinse comprises all the water required to make the replenisher for the first process solution.

10. A processing apparatus as claimed in claim 8 wherein the water used for the rinse comprises part of the water required to make the replenisher for the first process solution.

11. A processing apparatus as claimed in claim 7 wherein each the processing solutions is introduced by means of an opening located in an upper region of an inclined plane.

12. A processing apparatus as claimed in claim 7 wherein the rinse solution is introduced by means of an opening located in an upper or lower region of an inclined plane.

13. A processing apparatus as claimed in claim 12 wherein the opening for introduction of the rinse solution is located in the same inclined plane as an opening for introduction of the first solution, the opening for the rinse solution being located further up the plane than the opening for the first solution.

14. A processing apparatus as claimed in claim 13 wherein an aperture is located between the opening for the rinse solution and the opening for the first solution, the exit aperture being in connection with a recirculation system of the first solution.

* * * * *